US005255612A

United States Patent [19]

Anderson

[11] Patent Number: 5,255,612

[45] Date of Patent: Oct. 26, 1993

[54] APPARATUS FOR SECURING AN ARTICLE TO A USER'S LEG

[76] Inventor: Rolf Anderson, 131 S. Clark, Forest City, Iowa 50436

[21] Appl. No.: 965,788

[22] Filed: Oct. 23, 1992

[51] Int. Cl.[5] ..... A47B 23/00

[52] U.S. Cl. ..... 108/43; 108/115; 108/127; 108/129

[58] Field of Search ..... 108/43, 115, 127, 129; 206/805; 224/267, 219, 222; 24/67.11

[56] References Cited

U.S. PATENT DOCUMENTS

| | | | |
|---|---|---|---|
| 2,692,174 | 10/1954 | Whitehead | 108/43 |
| 2,783,109 | 2/1957 | Frey | 108/43 |
| 2,787,507 | 4/1957 | Powers | 108/43 |
| 3,185,113 | 5/1965 | Nathan et al. | 108/43 |
| 5,176,274 | 1/1993 | Jenkins | 108/43 |

*Primary Examiner*—Clifford D. Crowder
*Assistant Examiner*—Gloria Hale
*Attorney, Agent, or Firm*—Kent A. Herink; Brian J. Laurenzo; Brett J. Trout

[57] ABSTRACT

A securement device for releasable attachment of a lapboard to a user's leg includes a table member and a pair of in-folding leg members, one each of which is attached for hinged movement relative to a corresponding side edge portion of the table member. Elastic webbing interconnects the free end portion of each leg member to a central portion on the underside of the table member. The securement device is centered on a user's leg with the leg members bracing the table member to prevent displacement thereof as a result of ordinary unbalanced imposed forces. When removed from a user's leg, the securement device folds to a compact storage position flush with the table member.

17 Claims, 2 Drawing Sheets

APPARATUS FOR SECURING AN ARTICLE TO A USER'S LEG

BACKGROUND OF THE INVENTION

The present invention relates generally to lapboards and, more specifically, to an apparatus for releasably securing an article such as a writing surface to the leg of a user.

Lapboards have been in use for many years, particularly by airplane pilots who use such devices to steady charts, checklists, and the like in their laps while operating an airplane. An example of a typical lapboard is described in U.S. Pat. No. 3,407,757. The lapboard is releasably secured to the leg of a user to provide a semi-stable surface which permits a more expanded range of motion for the user. A lapboard must have a sufficient degree of stability when mounted to the leg of a user to support the desired article and to permit ordinary use of the article. The prior art method for achieving such stability is to add rigid shoulders to the underside surface of the lapboard, which shoulders will be positioned during the use on either side of the leg of a user. The drawback of such lapboards, however, is that they do not sit in a flat, compact position when removed from the leg of a user and placed on a typical flat surface such as a table or desk. Accordingly, a user of these lapboards must typically detach the writing pad from the lapboard for use thereof other than in the lap of a user. The difficulties encountered in the prior art discussed hereinabove are substantially eliminated by the present invention.

SUMMARY OF THE INVENTION

The invention consists of a lapboard for use as a writing surface or for stable support on the leg of a user and which is adaptable between an operating position attached to the leg of a user and a folded, compact storage position closely adjacent to the underside of the writing surface. The lapboard includes a substantially rectangular table member and a pair of in-folding leg members, one each of which is attached on either side of the centerline of the table member for hinged movement below the table member. In one embodiment, elastic webbing interconnects the free-end portions of each of the leg members to a central portion of the underside of the table member.

In use, the central portion of the underside of the table member will rest atop the leg of a user. The leg members will be in supporting contact engagement with the corresponding side of the user's leg and act to brace the table member against pivotal displacement around the leg of the user. The elastic webbing which interconnects the leg members and the underside of the table member will stretch to conform to the contour of the upper surface of the user's leg yet still hold the leg members against the leg of a user to prevent pivotal displacement of the lapboard.

An object of the invention is to provide a securement device for releasable attachment to a user's leg for stably supporting a writing surface or other article.

A further object of the invention is to provide a lapboard which, when detached from a user's leg, folds to a compact storage position closely adjacent to the underside of the article to which the lapboard is attached.

Another object of the invention is to provide a lapboard for supporting a writing surface or other article on the leg of a user to permit limited motion to user without detachment of the lapboard or supported article.

These and other objects of the invention will become apparent upon a review of the following specifications, attached drawings, and the claims.

DETAILED DESCRIPTION OF A PREFERRED EMBODIMENT

Figure 1:
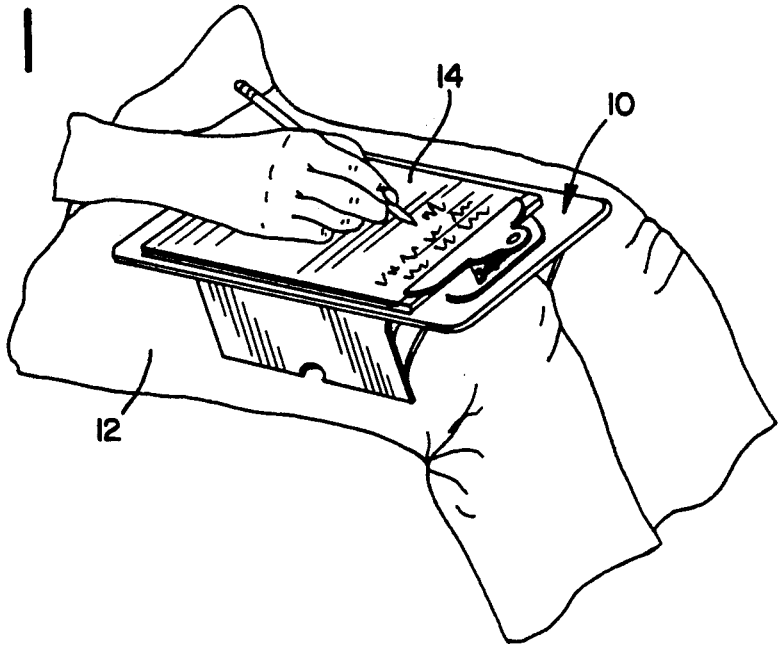
FIG. 1 is a perspective view of the invention attached to a user's leg and supporting a laptop computer.

Illustrated in FIG. 1, generally at 10, is a securement device for releasable attachment to a leg 12 of a user. In the preferred embodiment, a pad of paper 14 is releasably secured to and supported by the securement device 10 in a convenient position for writing by a user.

Figure 2:
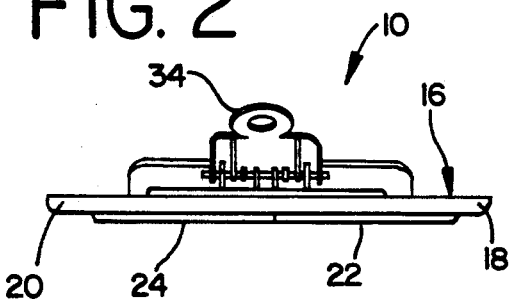
FIG. 2 is a side elevational view of the invention shown in the folded, storage position.
Figure 3:
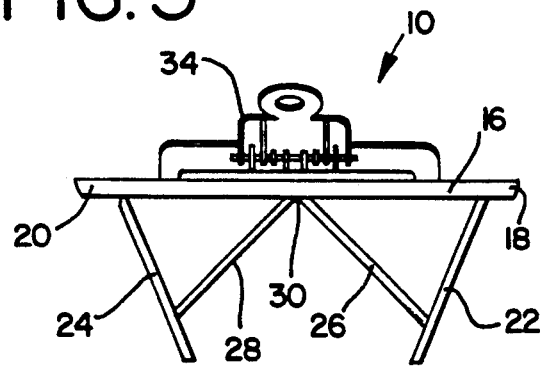
FIG. 3 is a side elevational view of the invention in the unfolded position preliminary to attachment to a leg of a user.

The securement device 10 includes a substantially rectangular table member 16 which has a left side edge portion 18 and a right side edge portion 20 (FIGS. 2 and 3). The width of the table member 16 is equal to or greater than the transverse width of the user's leg 12. A pair of substantially rectangular leg members, left leg member 22 and right leg member 24, are attached at an upper or outer edge portion thereof by a fabric hinge to the table member 16 near the side edge portions 18 and 20, respectively, of the table member 16 for hinged movement therebelow. The free end portions of the leg members 22 and 24 are independently interconnected to a central region on the underside of the table member 16 by elastic webbing 26 and 28, respectively. In the preferred embodiment, the elastic webbing 26 and 28 is sewn both to the free end sections of the leg members 22 and 24 and to the underside of the table member 16 at 30.

Figure 6:
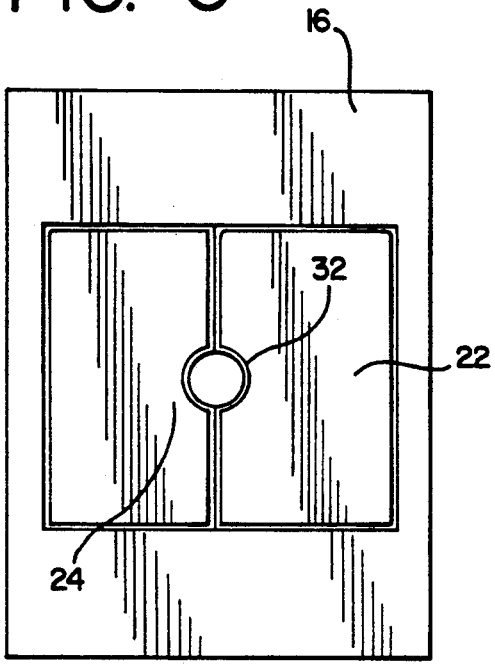
FIG. 6 is a bottom plan view of the lapboard in the folded, storage position.

The construction of the securement device 10 permits the leg members 22 and 24 to be folded inwardly to be adjacent to the underside of the table member 16, as illustrated in FIG. 2. In the preferred embodiment the longitudinal dimension of the leg members 22 and 24 are less than the longitudinal dimension of the table member 16 and the latitudinal dimension of the leg embers 22 and 24 are less than one-half of the latitudinal dimension of the table member 16 (FIG. 6). The underside of the table member 16 is recessed so that when the leg members 22 and 24 are folded inwardly they rest flush with the underside of the table member 16. The elastic webbing 26 and 28, being flexible, will automatically fold and be retained between the table member 16 and the leg members 22 and 24.

In the preferred embodiment the leg members 22 and 24 each have a scallop cut substantially midway along the free end side of the leg members 22 and 24 (FIG. 6). The scallop cuts allow for easier grasping of the free end portions of the leg members 22 and 24.

The securement device 10 is releasably attached to the leg 12 of a user by grasping the free end portions of the leg members 22 and 24 and pivoting the leg members 22 and 24 outwardly while simultaneously moving the underside of the table member 16 into contact engagement with the upper surface of the user's leg 12. The leg members 22 and 24 are of a length that is less than one-half the width of the table member 16 and greater than the ventral to dorsal dimension of the user's leg 12 so that the contact points of the free end portions of the leg members 22 and 24 with the user's leg 12 are substantially on the side surface thereof. The elastic webbing 26 and 28 will stretch to conform substantially to the contour of the upper surface of the user's leg 12 whereby the free end portions of the leg member 22 and 24 will be in supporting engagement on either side of the user's leg 12.

Figure 4:
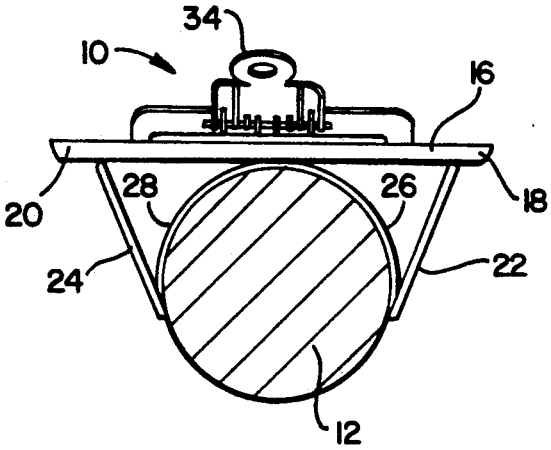
FIG. 4 is a cross sectional view taken along the line 4—4 of FIG. 1.

As can be seen in FIG. 4, the top portion of the user's leg 12 is substantially and snugly encircled by the elastic webbing 26 and 28 so as to prevent relative pivotal movement of the securement device 10 about the longitudinal axis of the user's leg 12. Additionally, the leg members 22 and 24 brace the side edge portions 18 and 20 to stabilize the table member 16 and prevent relative pivoting movement between the table member 16 and the user's leg 12. It has been found that the securement device 10 provides a surprisingly stable and comfortable supporting surface on which a variety of activities may be performed.

The securement device 10 is useful for serving as a support for a large variety of articles. In the preferred embodiment, a clip 34 is attached to the top side of the lapboard and is used to secure a pad of writing paper 14 to the table member 16.

Figure 5:
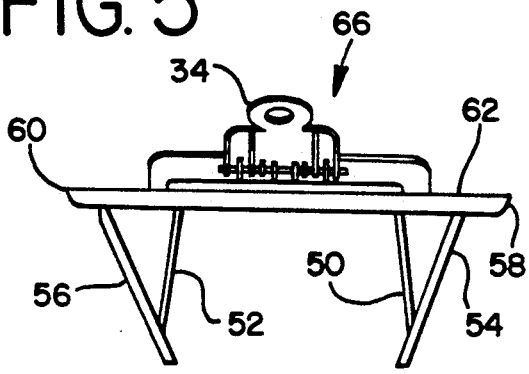
FIG. 5 is a side elevational view of an alternate embodiment of the invention showing the elastic webbing attached to the underside of the table member in an intermediate position between the leg members and the centerline of the table member.
Figure 9:
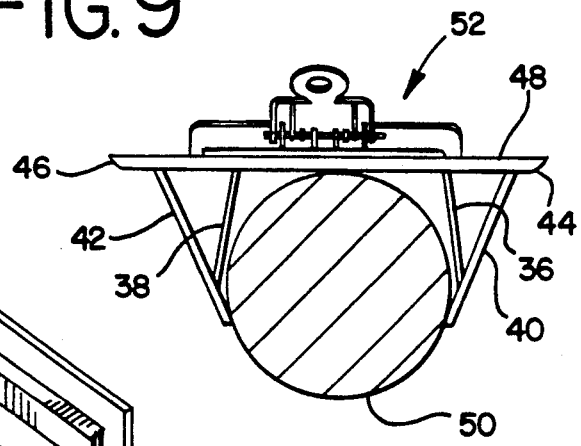
FIG. 9 is a cross sectional view of the alternate embodiment of the invention attached to a user's leg showing the elastic webbing attached to the underside of the table member in an intermediate position between the leg members and the centerline of the table member.

In an alternative embodiment of the present invention the plastic webbing 36 and 38 connecting the free end portions of the leg members 40 and 42 is connected to the underside of the table at a point located between a centerline running between the left and right side edge portions 44 and 46 of the table member 48 and the respective side edge portions 44 and 46 of the table member 48 (FIG. 5). In this embodiment very little of the elastic webbing 36 and 38 contacts the user's leg 50 yet the elastic webbing 36 and 38 still secures the leg members 40 and 42 of the securement device 52 tightly enough against the user's leg 50 so as to prevent relative pivotal movement of the securement device 52 about the longitudinal axis of the user's leg 50 (FIG. 9).

Figure 7:
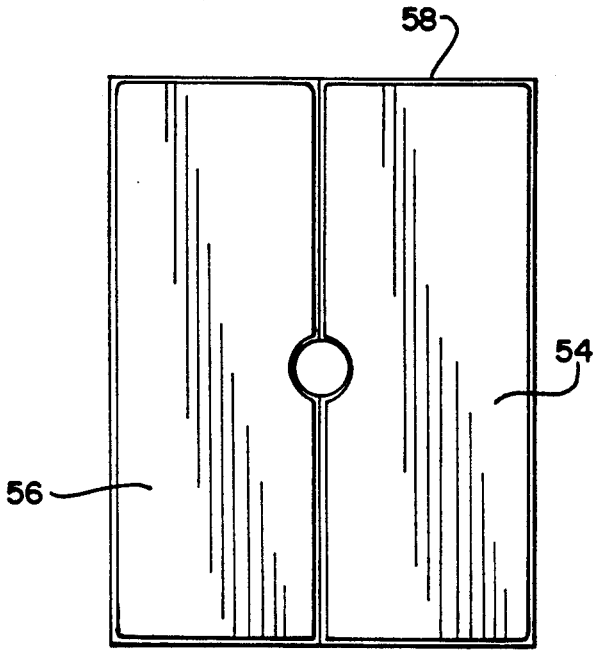
FIG. 7 is a bottom plan view of an alternate embodiment of the invention showing the leg members extending the full length of the lapboard.

In another alternative embodiment of the present invention the leg members 54 and 56 extend longitudinally to the edge of the table member 58 (FIG. 7).

Figure 8:
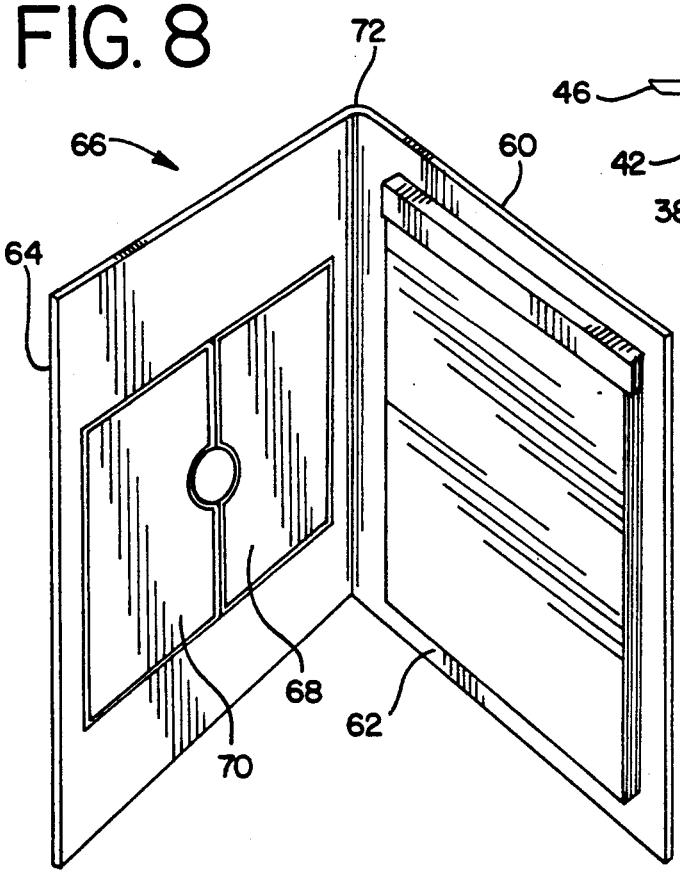
FIG. 8 is a prospective view of the portfolio embodiment of the invention.

In yet another alternative embodiment of the present invention a cover member 60 having one side suitable as a utility surface 62 is hingeably connected to one side of the table member 64 so as to form a portfolio 66. This embodiment is designed so that when the portfolio 66 is closed the utility surface 62, suitable for writing or other activity, and the leg members 68 and 70 are on opposite interior faces of the portfolio's 66 (FIG. 8). As the portfolio 66 is opened the portfolio hinge 72 hyperextends to allow the portfolio 66 to fold back upon itself leaving the leg members 68 and 70 on one side and the utility surface 62 on the other. The leg members 68 and 70 may then be extended and secured to a user's leg as described above. When closed this embodiment of the invention hides the leg members 68 and 70 from sight giving the appearance of a standard portfolio.

Although the invention has been described with respect to a preferred embodiment thereof, it is to be also understood that it is not to be so limited since changes and modifications can be made therein which are within the full intended scope of this invention as defined by the appended claims.

I claim:

1. A securement device for releasable attachment to a user's leg, comprising:
   (a) a table member having a centerline and a pair of opposing side portions to either side of said centerline and separated by a distance of at least the transverse width of the user's leg;
   (b) a pair of in-folding leg members one each of which is attached for hinged movement to either side of said centerline of said table member, each of said leg members being of a length less than one-half the distance separating said opposing side portions and at least one-half the ventral-dorsal dimension of the user's leg;
   (c) means for releasably securing said leg members in a position substantially flush with the bottom side of said table member;
   (d) elastic means interconnecting a free end portion of each said leg member to said bottom side of said table member.

2. A securement device as described in claim 1, wherein said table member is substantially rectangular and said leg members are attached to transversely opposite edge portions thereof.

3. A securement device as described in claim 1, wherein said leg members are of a width less than one-half of the distance between said hinged attachment sites.

4. A securement device as defined in claim 1, wherein said elastic means includes elastic webbing.

5. A securement device as defined in claim 1, wherein said leg members are movable between an in-folded position against said table member and a folded out position extending said elastic means.

6. A securement device as defined in claim 5, wherein said leg members, when in-folded, present a substantially flat, level supporting surface.

7. A securement device as defined in claim 6, wherein the longitudinal dimension of the leg members is less than the longitudinal dimension of the table member.

8. A securement device as defined in claim 7, wherein said bottom side of said table member contains a recess so that said leg members, when in-folded, present a substantially flat, level supporting surface.

9. A securement device as defined in claim 1, wherein said free end portions of said leg members are in contact with the user's leg when said table member is releasably attached to the user's leg.

10. A securement device as defined in claim 1, wherein said elastic means conforms substantially to the leg of the user when said table member is attached to the leg of the user.

11. A securement device as defined in claim 1, further comprising a scallop cut on the side of at least one leg member.

12. A securement device as defined in claim 1, wherein the longitudinal dimension of the leg members is equal to the longitudinal dimension of the table member.

13. A securement device as defined in claim 1, wherein said elastic means interconnects a free end portion of each said leg member to said bottom side of said table member substantially at said centerline.

14. A securement device as defined in claim 1, wherein said elastic means interconnect a free end portion of each said leg member to said bottom side of said table member between said centerline and the point where said leg members hingeably attach to said table member.

15. A securement device as defined in claim 1, wherein said means for releasably securing said leg members comprises a magnet attached to each leg member and a magnet of opposite polarity attached to the bottom side of said table member so as to engage and hold said leg members in a position substantially flush with the bottom side of said table member.

16. A securement device as defined in claim 1, further comprising a cover member with a utility surface hingeably connected to said table member so as to form a portfolio.

17. A securement device as defined in claim 16, wherein said portfolio can be folded back upon itself so that the utility surface can be accessed by a user while said leg members are releasably attached to the user's leg.

* * * * *